United States Patent [19]

Marshall et al.

[11] 4,069,942

[45] Jan. 24, 1978

[54] CHILD-RESISTANT PILL DISPENSER

[75] Inventors: Francis G. Marshall, Meriden; Edward F. Klimeck, Waterbury, both of Conn.

[73] Assignee: Eyelet Specialty Co., Inc., Wallingford, Conn.

[21] Appl. No.: 704,690

[22] Filed: July 12, 1976

[51] Int. Cl.[2] ..... B65D 83/04

[52] U.S. Cl. ..... 221/4; 206/534; 206/538; 215/216; 221/91; 221/154

[58] Field of Search ..... 206/533, 534, 538; 222/153; 161/121; 215/216, 218; 221/4, 5, 7, 82, 86, 91, 154

[56] References Cited

U.S. PATENT DOCUMENTS

| | | | |
|---|---|---|---|
| 3,884,379 | 5/1975 | Landen | 215/216 X |
| 3,939,788 | 2/1976 | Schneible | 215/216 X |
| 4,011,829 | 3/1977 | Wachsmann | 215/216 X |

FOREIGN PATENT DOCUMENTS

| | | | |
|---|---|---|---|
| 269,942 | 8/1964 | Australia | 206/534 |
| 442,615 | 1/1968 | Switzerland | 206/534 |

*Primary Examiner*—Robert B. Reeves
*Assistant Examiner*—David A. Scherbel
*Attorney, Agent, or Firm*—Hopgood, Calimafde, Kalil, Blaustein & Lieberman

[57] ABSTRACT

The invention contemplates a pill dispenser with internal capabilities of dispensing only a selected one of a plurality of pills at a given time, and closure mechanism for the dispenser incorporates a child-resistant safety-locking feature in addition to providing threaded closure and sealing of the dispenser. The body of the dispenser has plural spaced compartments for unit-pill retention, and the closure mechanism coacts with the dispenser to assure a fully closed condition of each and every pill compartment, when the closure is secured.

19 Claims, 9 Drawing Figures

SUN
SAT
FRI
THU
WED
TUE
MON

CHILD-RESISTANT PILL DISPENSER

BACKGROUND AND OBJECTS OF THE INVENTION

This invention relates to a container for pills which are considered hazardous, particularly to children, and more particularly to such containers having pill-dispensing and child-safety features.

It is an object of the invention to provide an improved container of the character indicated.

Another object is to provide improved child-safety mechanism for such a container.

A further object is to meet the above objects with structure provideding improved retention and selective dispensing of individual pills.

A general object is to meet the above objects with structure of inherent simplicity, low fabrication cost, and fool-proof operation.

Other objects and various further features of novelty and invention will be pointed out or will occur to those skilled in the art from a reading of the following specification in conjunction with the accompanying drawings.

SUMMARY OF THE INVENTION

The invention contemplates a pill dispenser of generally cylindrical shape and with an angularly distributed plurality of upwardly open individual pill compartments. A pill-dispensing lid member provides means for selecting the compartment from which one pill at a time is dispensible, and a closure-cap member has threaded removable engagement to the dispenser. Ratchet-engageable formations on the cap and container assure a ratchet-locked "safety" closure of the container, requiring concurrent manipulative operations of (a) ratchet disengagement and (b) unthreading rotation, in order to remove the cap and gain access to the contents of the container.

BRIEF DESCRIPTION OF THE DRAWING

In the drawing, which show, for illustrative purposes only, preferred forms of the invention.

DESCRIPTION OF THE PREFERRED EMBODIMENT

Figures 1, 2, 3, 4, 5, 6, 7, 8, 9:
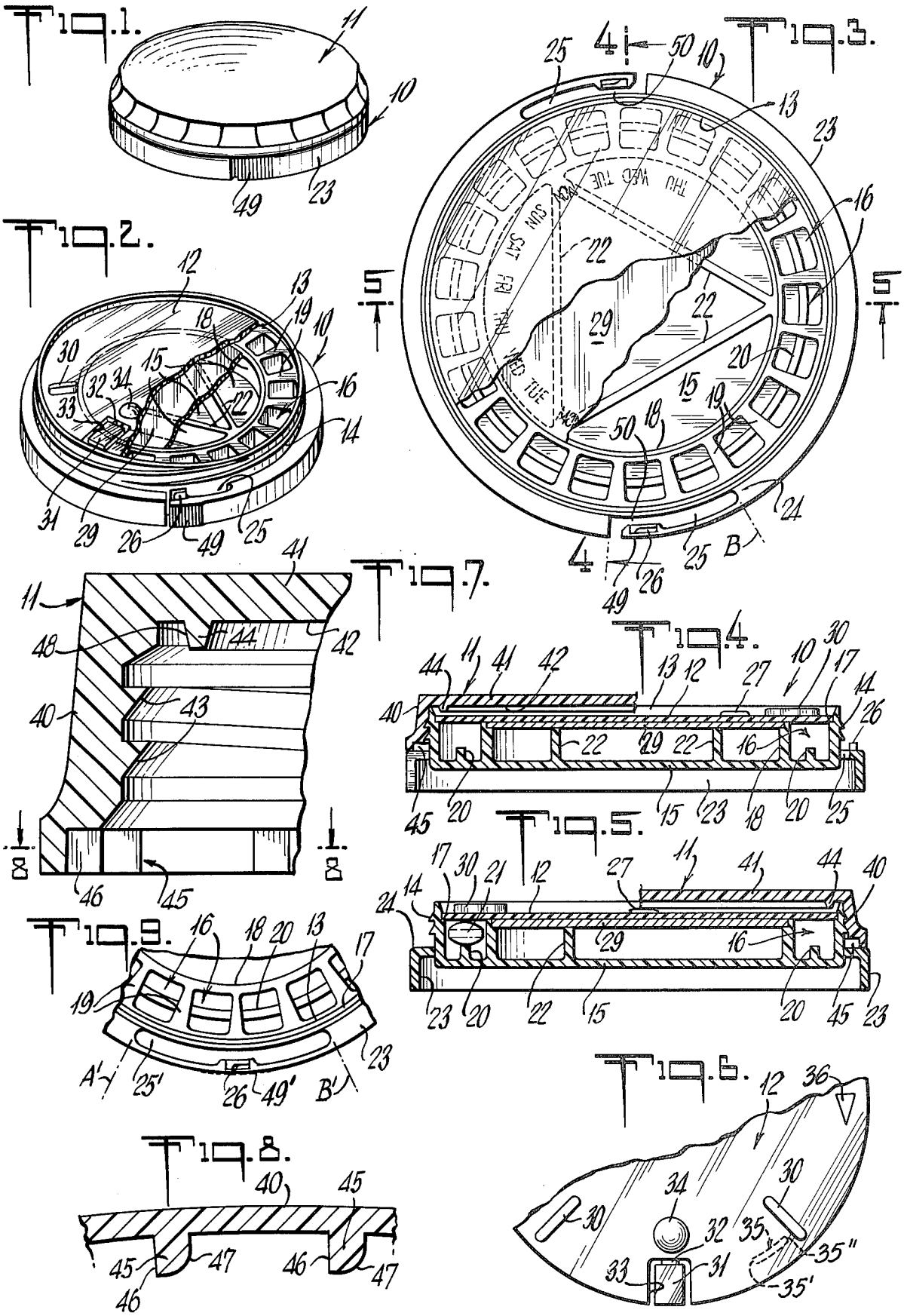
FIG. 1 is a perspective view of a closed and secured child-resistant pill-dispensing container of the invention.
FIG. 2 is a view similar to FIG. 1, with the closure cap removed, and with a portion broken-away to reveal internal construction.
FIG. 3 is a plan view of the parts of FIG. 2.
FIGS. 4 and 5 are sectional views, respectively taken at 4—4 and 5—5 in FIG. 3.
FIG. 6 is a fragmentary plan view of a part of FIG. 3.
FIG. 7 is an enlarged fragmentary sectional view of part of the closure cap of FIG. 1, the section being taken in a radially extending plane which includes the axis of the cap.
FIG. 8 is another enlarged fragmentary sectional view, taken at the plane 8—8 of FIG. 7.
FIG. 9 is a fragmentary plan view similar to FIG. 3 but to show a modification.

Referring initially to FIGS. 1 and 2, the invention is shown in application to a container comprising but three parts, each of which may be a simple piece, injection-molded of suitable plastic, such as polypropylene, or high-density polyethylene. When closed (FIG. 1), only two of these pieces are visible, a base member 10 and a closure-cap member 11; when a cap member 11 is removed (FIG. 2), the third or dispensing-lid member 12 is visible, in its assembled relation to base member 10.

Referring additionally to FIGS. 3 and 5, base member 10 is seen to comprise an upstanding body wall 13, externally formed with threads 14 for coaction with threads of cap member 11. Body wall 13 has a bottom closure wall 15 which is internally contoured to define a plurality of angularly spaced pill compartments 16. As shown, the number of compartments is 21 at equal angular spacing within an outer annulus defined between a circumferentially continuous shoulder 17 on body wall 13 and an inner annular wall 18, with angularly spaced radial walls 19 integrally connecting walls 13–18. Walls 18–19 terminate at their upper ends at the radial plane of shoulder 17, thus establishing a single seating plane for the lid member 12, which is essentially a flat disc. A central rib 20 rises centrally from the base of each compartment 16, appropriate to the dimensions of the pill size to be accommodated by each compartment, as suggested by the phantom outline of a pill 21 in FIG. 5. A triangle of upstanding reinforcing ribs 22 stabilizes wall 18 and its associated array of compartments 16, in relation to the bottom wall 15; preferably, ribs 22 extend upwardly to an elevation just short of the radial plane of shoulder 17, to accommodate press-fitted assembly of a calendar disc 29, as shown.

Base member 10 is further characterized by an outer circumferential skirt 23 connected to body wall 13 at radial offsets 24 and axially beneath threads 14; skirt 23 extends downwardly from the offsets 24 and is the means of support of the entire structure, as when set upon a table top. At one or more angular locations, an arcuate slot 25 in the offset portion 24 of the skirt establishes between angularly spaced limits A–B a locally compliant and radially inwardly yieldable region of skirt 23, such region being provided with an upstanding ratchet-tooth formation 26 for coaction with cap member 11, as will later be more fully described.

Detent ribs 27 are formed at angularly spaced locations in body wall 13. These ribs extend radially inward and have ramp-sloped upper surfaces for easy-action interference with the outer edge of lid member 12 upon its assembly to shoulder 17. The lower wall of each rib 27 is preferably sharply defined in a single radial plane for snapped positive axial retention of an inserted lid member 12.

In the additional context of FIG. 6, the lid member 12 will be seen as an essentially flat circular disc with plural spaced radially extending ribs 30, for finger engagement, to facilitate selective angular indexing advances of disc 12 within body wall 13; for a purpose which will later be more clear, the radial extent of ribs 30 preferably spans from shoulder 17 to wall 18. Disc 12 is provided with pill-dispensing means in the form of a tab 31 having locally reduced and therefore weakened integral connection 32 to the remainder of lid member 12. By lifting tab 31, access is had through an opening 33 direct to one of the compartments 16, and if the connection 32 is frangible, then tab 31 may be discarded, once it is broken off, thus signifying at once that the container contents are no longer in their original factory-packed condition. For the user's convenience in visually recalling to date of use, a magnifying lens 34 is adjacent the tab location in register with the successive-day index markings on the calander disc 29.

The underside of disc 12 is also characterized by plural rib formations 35, but these provide an angle-locating or index-locating function and assure but a single direction of indexability, the same being suggested to the user, as by a raised arrow formation 36 in the upper surface of disc 12. Preferably, ribs 35 are of angular extent to locate within any given compartment 16, being limited by the opposed radial walls 19 of the compartment. Generally, each rib 35 is ramp-sloped, rising from a reduced end 35' to a steep-walled end 35". The nature of the reduced end 35' is to provide relatively small resistance to indexing rotation of disc 12 in the clockwise direction indicated by arrow 36, but rotation in the counter-clockwise direction is opposed by the steep-walled flat abrupt end 35" of each rib 35, in its abutment with the nearby radial wall 19 of the associated compartment 16. Thus, once a pill 21 has been dispensed via opening 33 for a given indexed position of disc 12, disc 12 will be retained by means 35 in the same indexed position. For access to the next pill 21, disc 12 must be rotated clockwise, and a one-compartment index for such access is signalled by a snap, as the ends 35" clear the radial walls 19 over which they have just been resiliently cammed.

Referring additionally to FIGS. 7 and 8, cap member 11 is seen to comprise a skirt wall 40 which is closed at one end by a wall 41 which may have a flat interior wall surface 42. Threads 43 in the bore of skirt 40 are for engagement with container-body threads 14, and a circumferentially continuous rib 44 projects downwardly from the closed wall 41 for frictional engagement with the upper surface of disc 12 (and radially outside ribs 30) when the closure cap is in its secured, container-sealing position, thus assuring full closure of all compartments 16 except for the compartment to which opening 33 has been indexed. The lower open end of skirt 40 is shown outwardly flared beneath threads 43 to enable definition of the plural radially inwardly facing ratchet teeth 45 which extend in continuous succession around the inner lower edge of skirt 40. As seen in FIG. 8, each of these teeth 45 has a flat radially inward wall 46 for one-way-engaging antirotational contact with the base ratchet tooth or teeth 26, in the thread-off direction of engaging threads 14–43; each tooth 45 also has a rounded opposite wall 47, for ratchet-escaping action at 26 in the thread-on direction of engaging threads 14–43.

It has been explained above that the ratchet-tooth formation 26 is at a local radially compliant deformable locale of the base-member skirt 23, adjacent an arcuate slot 25. That being the case, placement of cap member 11 over wall 13 and thread-on advance of the engagement 14–43 draws members 10–11 together to the point of initial and then increasingly positive, escaping ratchet engagement at 26–45. In final approach to the fully closed position, the upper inside edge of wall 13 develops circumferential sealing contact with the adjacent tapered wall 48 of rib 44, and rib 44 clamps down upon disc 12 (over shoulder 17) while the flat cap surface 42 engages radial ribs 30 to assure additional clamping of disc 12 to the inner annular wall 18.

In the form shown in FIGS. 1 to 4, the compliantly yieldable supporting region for tooth 26 is a circumferentially arcuate cantilevered arm 49, with tooth 26 supported at the free or cantilevered end, arm 49 being defined by an outwardly open passage to one limit (A) of the arcuate slot 25. Tooth 26 will be understood to have a flat locking face for antirotational abutment with the corresponding face 46 of each cap tooth 45. And to release the locked engagement, the radial clearance 50 with which the free end of arm 49 may be radially inwardly depressed will be understood to provide for disengagement of the ratchet-locking tooth faces, whereupon the cap member 11 may be unthreaded from base member 10.

In the form shown in FIG. 9, the arcuate slot 25' again extends between angular limits A'–B', but the skirt 23 remains circumferentially continuous, while the ratchet tooth 26 is formed centrally of the commpliant bridge portion 49' of skirt 23. Action is otherwise as described for the embodiment of FIGS. 1 to 4.

Preferably, security is enhanced by providing base-member ratchet action at plural spaced locations. Thus, in FIGS. 1 to 4, slots 25, arms 49 and teeth 26 are provided in duplicate at diametrically opposed locations, and a similar preferred arrangement of duplicate slots 25', bridges 49' and teeth 26 will be understood for the FIG. 9 embodiment.

The structures of both the described embodiments of the invention will be seen to have achieved all stated objects. Not only is the locking action positive and foolproof, for the entire useful period of a factory-filled container, but the mechanism is sufficiently rugged as to lend itself to repeated reloading and reuse as a dispensing container. At no time can the compliantly suspended ratchet teeth be damaged due to excessive radially inward depression, because the clearance available for such depression is at all times limited by the mere traversal of the effective radial width of the slot 25, 25'. Once opened, the nature of lid-member indexing is such as to assure a clockwise sequence of pill availability, total consumption being manifested upon indexing into a first empty compartment location. And the secured condition of the container assures sealed retention of pills in their individual compartments.

While the invention has been described in detail for the preferred forms shown, it will be understood that modifications may be made without departure from the invention. For example, the multiple-ratchet action need not be cophasal as in the presently disclosed embodiments, but rather may involve dual ratcheting in phase-interlace, as described for a different child-safety closure mechanism in Landen U.S. Pat. No. 3,884,379, wherein the ratchet-snap action for each of two ratchets is caused to alternate between the two ratchets, thus achieving twice as many possible ratchet-locked angular positions as there are ratchet teeth in the skirt of the cap member.

What is claimed is:

1. A pill-dispensing container with safety closure, comprising: a circular base member including an upstanding body wall with external thread formations, a circumferentially and downwardly extending skirt integrally connected to said body wall at an axial location beneath said threads, said base member having an angularly distributed plurality of upwardly open individual pill compartments radially within said body wall, the open ends of said compartments terminating at an axial location short of the upper end of said body wall; a pill-dispensing lid member rotatably mounted to and axially retained by said base member to close said compartments within the upper limit of said body wall, said lid member having unit-pill dispensing means in radial register with one of the pill compartments for each of a selectable plurality of angular positions thereof; and a closure-cap member including a skirt with internal threads for selective engagement with said body-wall threads; said closure-cap member and said lid member having rotation-resistant engagement when said closure-cap member is thread-engaged to said body wall, said cap-member skirt having plural radially-inwardly directed ratchet teeth axially beneath the threads thereof, said base-member skirt having at one angular location a radially inwardly compliant portion whereby said inwardly compliant portion may be transiently and resiliently inwardly displaced, and a ratchet-locking tooth formation carried by said compliant portion and having (a) ratchet-escaping engagement with cap-member teeth in the thread-on direction of cap-member threaded engagement with said base member and (b) ratchet-locking engagement with said cap-member teeth in the thread-off direction of such threaded engagement.

2. The pill-dispensing container of claim 1, in which said inwardly compliant portion is one of two such ratchet-toothed portions at generally opposed locations of said base-member skirt.

3. The pill-dispensing container of claim 1, in which said inwardly compliant portion is one of a plurality of such ratchet-toothed portions at a plurality of angularly spaced locations around said base-member skirt.

4. The pill-dispensing container of claim 1, wherein the underside of said lid member includes a local downward projection having detent engagement with a pill-compartment wall to retain a selected pill-dispensing angular position of said lid member.

5. The pill-dispensing container of claim 4, in which said local downward projection is one of a plurality of such projections at angularly spaced locations, all such projections having detent-engagement with walls of different compartments at any given detent-retained position of said lid member.

6. The pill-dispensing container of claim 4, in which said downward projection has an effective angular width approaching that of a pill compartment.

7. The pill-dispensing container of claim 4, in which said downward projection defines a rib which terminates at one angular limit with a relatively sharply defined step having locking engagement with a pill-compartment for one direction of attempted lid-member rotation.

8. The pill-dispensing container of claim 7, in which said rib includes a ramp formation at its other angular limit for escaping detent engagement with a pill-compartment wall in the other direction of attempted lid-member rotation.

9. The pill-dispensing container of claim 1, in which said closure-cap member includes on the inner surface of the closed end thereof a circumferentially continuous downwardly projecting annular rib for lid-member engagement to establish rotation-resisting retention of said lid member.

10. The pill-dispensing container of claim 1, in which said pill-dispensing means comprises a tab portion of said lid member having locally weakened connection to the remainder of said lid member, said tab portion being displaceable with respect to the remainder of said lid member to provide local pill-dispensing access to the compartment with which said tab portion is in instantaneous register.

11. The pill-dispensing container of claim 10, in which said tab portion is frangibly connected to the remainder of said lid member.

12. The pill-dispensing container of claim 1, in which said radially inward compliant portion of said base-member skirt comprises an arcuate tab having circumferentially directed cantilevered connection to said base-member wall, said ratchet-tooth formation being carried at the cantilevered end of said tab.

13. The pill-dispensing container of claim 1, in which said base member has a circumferentially directed arcuate slot between corresponding skirt and body-wall regions of said base member, said skirt being circumferentially continuous and radially inwardly compliantly displaceable between both angular limits of said slot, said ratchet-tooth formation being carried by said skirt between said angular limits.

14. The pill-dispensing container of claim 1, in which said base member has a circumferentially directed arcuate slot between corresponding skirt and body-wall regions of said base member, said slot extending between local angularly spaced limits and being radially outwardly locally open at a location angularly spaced from one of said limits to define a radially inwardly compliant cantilevered tab portion of said base-member skirt, said ratchet-tooth formation being carried by said skirt at the cantilevered end of said tab portion.

15. The pill-dispensing container of claim 1, in which all compartment walls terminate in a single radial plane at the open ends of the compartments, said lid member having flat circumferentially continuous closing relation to all other compartments when said pill-dispensing means is in register with a selected one of said compartments.

16. The pill-dispensing container of claim 15, in which said lid member comprises a flat circular disc with a plurality of angularly spaced radially extending ribs projecting above the upper surface of said disc and to a radial extent spanning the radial limits of the pill compartments, the axial extent of said rib projections being such in relation to the inner contour of the closed end of said cap member that in the secured and closed position of said cap member said cap member clamps said lid member to said compartment-closed position via said ribs.

17. The pill-dispensing container of claim 1, in which said base member has a radial clearance between said radially inward compliant portion and the adjacent portion of said body wall, said radial clearance in the ratchet-locked condition being slightly in excess of the radial overlap of ratchet-locked teeth, whereby said radially inward compliant portion is never more displaceable than necessary to release a ratchet-locked condition.

18. A pill-dispensing container with safety closure, comprising: a circular base member including an upstanding body wall with an external thread formations, a circumferentially and downwardly extending skirt integrally connected to said body wall at an axial location beneath said threads, said base member having an angularly distributed plurality of upwardly open individual pill compartments radially within said body wall, the open ends of said compartments terminating at an axial location short of the upper end of said body wall; a pill-dispensing lid member rotatably mounted to and axially retained by said base member to close said compartments within the upper limit of said body wall, said lid member having unit-pill dispensing means in radial register with one of the pill compartments for each of a selectable plurality of angular positions thereof; and a closure-cap member including a skirt with internal threads for selective engagement with said body-wall threads; said cap-member skirt having plural radially-inwardly directed ratchet teeth axially beneath the threads thereof, said base-member skirt having at one angular location a radially inwardly compliant portion whereby said inwardly compliant portion may be transiently and resiliently inwardly displaced, and a ratchet-locking tooth formation carried by said compliant portion and having (a) ratchet-escaping engagement with cap-member teeth in the thread-on direction of cap-member threaded engagement with said base member and (b) ratchet-locking engagement with said cap-member teeth in the thread-off direction of such threaded engagement.

19. The pill-dispensing container of claim 18, in which said base member and said closure-cap member are each single injection-molded plastic parts.

* * * * *